United States Patent [19]

Perkins et al.

[11] Patent Number: 4,570,819

[45] Date of Patent: Feb. 18, 1986

[54] FILL MEANS FOR CRYOGENIC FLASKS

[75] Inventors: Warren E. Perkins, Port St. Lucie; Mark T. Novak, Jensen Beach, both of Fla.

[73] Assignee: Cryo, Corporation, Fort Pierce, Fla.

[21] Appl. No.: 556,390

[22] Filed: Nov. 30, 1983

[51] Int. Cl.[4] ..... F17C 6/00

[52] U.S. Cl. ..... 220/374; 141/97

[58] Field of Search ..... 128/201.21; 141/1, 97; 220/85 F, 86 R, 369, 370, 371, 373, 374, 901

[56] References Cited

U.S. PATENT DOCUMENTS 4,211,086 7/1980 Leonard et al. ..... 128/201.21 X

FOREIGN PATENT DOCUMENTS 414107 5/1925 Fed. Rep. of Germany ..... 128/201.21

*Primary Examiner*—Stephen Marcus
*Assistant Examiner*—Mark Thronson
*Attorney, Agent, or Firm*—Roland H. Shubert

[57] ABSTRACT

Methods and structures are provided for filling cryogenic flasks such as those used in portable, liquid oxygen therapy systems. A circular baffle plate is disposed within the flask neck near the bottom thereof and is sized to allow a narrow annular opening between the baffle edge and the flask neck wall. The liquid fill line is extended downwardly through the baffle plate, so as to discharge liquid below the plate. The baffle plate functions to provide a gas-liquid separation zone within the flask neck; to provide a radiation shield while liquid is present in the flask; and to provide a gas trap to minimize liquid venting in case of tip-over.

12 Claims, 1 Drawing Figure

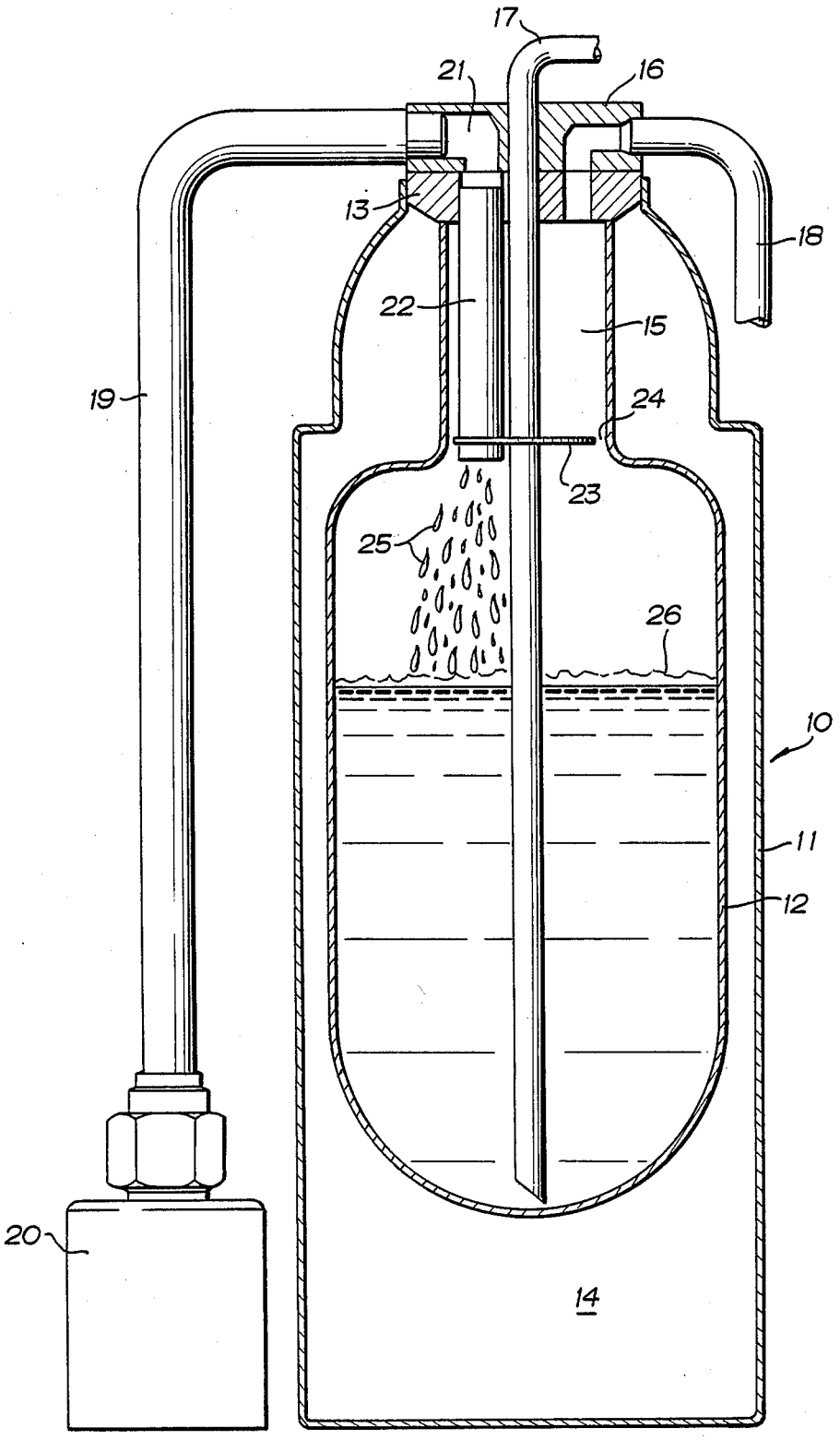
17
21
16
13
18
22
15
19
24
23
25
26
10
11
12
20
14

FILL MEANS FOR CRYOGENIC FLASKS

BACKGROUND OF THE INVENTION

This invention relates generally to means for filling an insulated flask with a cryogenic liquid.

In a specific embodiment, this invention relates to means for filling a small, portable, liquid oxygen storage container used for the therapeutic dispensing of oxygen.

There is often need for filling an insulated flask with a cryogenic liquid such as liquid nitrogen or liquid oxygen. One common circumstance in which small insulated flasks are filled with liquid oxygen on a routine basis is in the field of oxygen therapy. There are a number of commercially available liquid oxygen therapy systems, both stationary and portable, to provide oxygen for persons of impaired breathing ability. Such systems typically include a relatively large capacity, stationary home unit and a much smaller portable unit sized to provide from about three to about fourteen hours of continuous oxygen supply. The portable unit is refilled as needed, often one or more times per day, from the larger stationary unit.

The flask used in typical liquid oxygen therapy units is generally cylindrical in shape with a relatively narrow neck and is sized to hold from about one and one half to four pounds of liquid oxygen. It is typically constructed of stainless steel with vacuum insulation as glass is too fragile to withstand the working pressure of some 10 to 30 psi maintained within the flask during use. Also, glass is susceptable to breakage upon moderate impact making it unsuitable for use in a portable unit.

The top of the flask is closed and sealed with a metal flange incorporating conduit means communicating between the interior and the exterior of the flask. One conduit is provided as a liquid fill line. Another is provided to vent gas from the container while a third is connected to a dip tube extending to near the bottom of the flask for withdrawal of liquid oxygen. During refilling of the portable unit from the larger stationary unit, the fill line is connected to a liquid oxygen line from the larger unit through a quick connect coupling to establish open communication between the interiors of the two containers. Liquid oxygen flow is established from the large unit to the portable flask by opening the portable unit vent line.

Because the liquid fill line terminates within the portable flask at a location relatively close to the vent port, there is a tendency for liquid droplets to become entrained in the venting gas and to be carried from the container. Besides being wasteful of liquid oxygen, this condition presents something of a hazard in that liquid oxygen spattering on the skin of a user can produce burns. In addition, liquid oxygen carried out the vent line during filling tends to mask the full flask condition which is ordinarily determined by liquid issuing from the vent line. Consequently, there has been a tendency on the part of some users to only partially fill a portable unit resulting in an important loss of breathing oxygen capacity. It is apparent that an improved filling system for liquid oxygen therapy systems would have significant benefit to the users thereof.

SUMMARY OF THE INVENTION

A small flask for the containment and dispensing of liquid oxygen or other cryogenic liquid may be filled more rapidly without liquid entrainment in the gas vented from the flask by provision of a baffle plate and fill tube arrangement within the flask neck. A liquid fill tube is extended downwardly to the base of the flask neck penetrating through and terminating just below a flat circular baffle plate. The baffle plate is sized such that a narrow annular opening is provided between the baffle edge and the flask neck wall. Space within the flask neck functions as a gas-liquid separation zone to strip liquid droplets from the gas vented from the flask top during filling. The baffle also functions as a radiation shield and to provide a gas trap at the top of the vessel in case of tip-over.

Hence, it is an object of this invention to provide improved means for the filling of small cryogenic containers.

It is a specific object of this invention to provide improved means for the filling of portable, liquid oxygen therapy units.

Another object of this invention is to allow rapid filling of oxygen flasks without loss of liquid in the gas vented from the flask during filling.

DESCRIPTION OF THE DRAWING

The drawing comprises a single FIGURE showing in a partial section, elevational view the improved filling means of this invention.

DESCRIPTION AND DISCUSSION OF THE INVENTION

The filling means of this invention will be described in relation to its use with a portable liquid oxygen therapy unit. Referring now to the FIGURE, portions of a portable, liquid oxygen therapy unit are shown generally at 10. The unit comprises a flask having an outer wall 11 and an inner wall 12. The outer and inner flask walls are fixedly held in a spaced apart relationship by closure flange 13 which also serves as a gas-tight seal for annular space 14 between the outer and inner walls. Space 14 is evacuated to form a high vacuum insulation which reduces heat transfer between the exterior of the flask and its contents to a minimum.

The upper portion of the inner flask wall is formed as an elongated, cylindrical, relatively narrow neck 15 sealed by closure flange 13 and manifold flange 16. A liquid oxygen withdrawal tube 17 extends through the closure and manifold flanges terminating at a point adjacent the flask bottom. A second conduit 18 extends from a top, normally vapor-filled point within neck 15 to the exterior of the container. Conduit 18 is normally closed by means of a valve (not shown) which is opened only during filling of the container.

A third conduit, liquid fill tube 19, is provided to fill the flask with liquid oxygen. The exterior end of fill tube 19 terminates in coupling means 20 which are adapted for connection to a mating coupling carried by a liquid oxygen source, typically a stationary liquid oxygen therapy unit. The other end of fill tube 19 is connected to manifold flange 16 as by brazing and communicates with manifold and closure flange port 21 which extends to the interior of flask neck 15. There is provided a stub fill line 22 extending downwardly from port 21 and terminating at a point at the approximate bottom of flask neck 15. A flat, circular baffle plate 23 is disposed just above the lower end of stub line 22 within the flask neck and adjacent the bottom thereof. The diameter of baffle plate 23 is set just smaller than the internal diameter of flask neck 15 so as to provide a narrow annular opening 24 between the edge of plate 23 and the flask wall. Width of annular opening 24 may appropriately range from about one thirty-second to about one-eighth inch.

Liquid oxygen withdrawal tube 17 and stub fill line 22 penetrate through baffle plate 23 and serve to hold plate 23 in fixed position by brazing attachment thereto. Plate 23 preferably is constructed of a metal having a low emissivity so as to inhibit radiant heat transfer between the cold liquid oxygen within the flask and the relatively warm closure flange 13. Polished stainless steel is suitable for this purpose and is preferred. Stub fill line 22 is preferably of thin wall construction of a metal having a low thermal conductivity so as to minimize heat leak. Again, stainless steel is preferred.

In the conventional arrangement of a liquid oxygen flask of this sort, the liquid oxygen fill means terminates at, or closely adjacent to, the bottom of closure flange 13. The flask is filled by securing it to a liquid oxygen supply through coupling 20 so as to establish open communication between the interior of the flask and the interior of the supply vessel. Vent conduit 18 is then opened reducing the pressure within the flask and causing liquid to flow from the supply vessel into the flask. Because the liquid oxygen within the supply vessel is at equilibrium temperature and pressure and because the pressure within the flask is less than that in the supply vessel, the liquid oxygen entering the flask tends to boil violently. Gaseous oxygen exiting the flask through vent conduit 18 tends to entrain liquid droplets of oxygen and to carry that liquid from the flask. The amount of liquid oxygen entrainment increases as the fill rate increases because of the increased rate of gas venting. A full flask condition is ordinarily signalled by liquid issuing from the vent line causing a characteristic popping sound. When a flask is recharged at a fast fill rate, the full flask condition is often masked by the entrained liquid carried with the venting gas. Consequently, a user often tends to stop liquid flow before the flask is full or to continue liquid flow after the flask is completely full. The first condition, a partially filled flask, presents a potential risk to the user of an unexpected loss of oxygen support at a time or place remote from replenishment. The second condition, that of overfill, wastes significant quantities of liquid oxygen.

The fill means of this invention including stub fill line 22 and baffle plate 23 obviates these problems. Extension of the liquid oxygen entry line downwardly to the bottom of the flask neck and provision of baffle plate 23 within the lower portion of the flask neck essentially eliminates entrainment of liquid oxygen in vent gas during filling. As shown in the drawing, the liquid oxygen stream tends to break apart into a cascade of droplets 25 as it exits from the bottom of stub fill line 22 because of boiling induced by the lower pressure within the flask. A substantial degree of separation between liquid droplets and gas occurs in the space between the liquid oxygen level 26 within the flask and the flask top. Venting gas must travel through the annular opening 24 between the baffle plate and the flask neck. The internal volume of the flask neck above the baffle plate acts as a gas-liquid separation zone allowing those few liquid droplets carried through the annular opening 24 to settle out. When the flask fills to the point that liquid rises in the flask neck, the sudden appearance of liquid in the vent gas provides a crisp and definitive full signal. Thus, the fill rate can be increased substantially over normal practice without liquid being carried from the vent line while at the same time increasing the safety and efficiency of the filling procedure.

Baffle plate 23 also performs other functions while liquid oxygen is present in the flask. By forming plate 23 of a low emissivity metal, polished stainless steel for example, it acts as a radiation shield to reduce transfer of heat into the flask. Closure flange 13 in conjunction with manifold flange 16 constitute a major heat leak into the flask. Those flanges are formed of metal, preferably stainless steel, and are exposed to ambient temperatures on their outer surfaces. Baffle plate 23, being interposed between the cold liquid oxygen surface and the flange bottom, acts to substantially reduce radiant heat transfer from the liquid to the flange.

The configuration of plate 23 within flask neck 15 also enhances the safety of a portable oxygen therapy unit in the case of tip-over. If an oxygen therapy unit of conventional construction is tipped over or placed on its side, liquid within the flask will contact the bottom of the closure flange. The flange is quite hot in comparison to the liquid temperature and liquid contact with the flange will cause a high rate of boil off resulting in a rapid pressure rise within the flask. There is customarily provided a pressure relief valve in both the vent line and liquid withdrawal tube circuits. One or both of these pressure relief valves will open under this increased pressure. Depending upon the attitude of the tipped flask, liquid rather than gas may be vented to relieve the pressure build up.

Baffle plate 23 prevents or minimizes the severity of such an occurrence. Upon tip-over, the space in the flask neck above the baffle plate acts as a gas trap to minimize the rate of gas evolution and gas, or liquid, venting. This result reduces the likelihood of injury from contact with spattering liquid and is decidedly less scary to the user.

As may be appreciated, the filling means of this invention provide a number of advantages both during filling and during use of a portable oxygen therapy system. It will be evident that minor changes and modifications may be made without departing from the spirit and scope of the invention as defined by the appended claims.

We claim:

1. Filling means for a liquid cryogen container comprising:

a vacuum insulated flask having a relatively small, elongated cylindrical neck;

cap means closing the top of the flask neck;

a thin flat, circular baffle having a circumferential edge and fixedly disposed across said flask neck adjacent the bottom thereof, the diameter of said baffle being slightly smaller than the interior diameter of said flask neck so as to provide a narrow, annular opening between the baffle edge and the flask neck;

a liquid fill tube communicating through said closure means and said baffle and terminating at a point just below said baffle, and vent means communicating through said closure means between the interior of said flask neck and the exterior of said flask.

2. The means of claim 1 wherein said baffle is fabricated of a metal effective as a radiant heat transfer inhibitor.

3. The means of claim 2 wherein said metal is polished stainless steel.

4. The means of claim 1 wherein said liquid fill tube is fabricated of a low thermal conductivity metal and is of thin wall construction.

5. The means of claim 4 wherein said metal is stainless steel.

6. The means of claim 1 including a liquid withdrawal tube extending through said cap means and said baffle and terminating at a fixed point adjacent the flask bottom.

7. Means for the interim storage and dispensing of liquid oxygen comprising:

a double walled, vacuum insulated metal flask having a relatively narrow, elongated and generally cylindrical neck;

cap means closing the top of the flask neck;

a liquid withdrawal tube extending through said cap means to a point adjacent the flask bottom;

a flat, circular baffle having a circumferential edge and fixedly mounted about the exterior of said withdrawal tube perpendicular to the axis of said tube at a point within but adjacent the bottom of said flask neck, the diameter of said baffle being slightly smaller than the internal diameter of said flask neck so as to provide a narrow, annular opening between the baffle edge and the interior wall of said flask neck;

a liquid fill tube communicating through said cap means and extending through said baffle at a location to the side of said withdrawal tube, said fill tube terminating at a point just below the baffle, and gas vent means communicating between the interior of the flask neck and the exterior of said flask.

8. The means of claim 7 wherein said baffle is fabricated of a metal effective as a radiant heat transfer inhibitor.

9. The means of claim 8 wherein said metal is stainless steel.

10. The means of claim 7 wherein said liquid fill tube is fabricated of stainless steel and is of thin wall construction.

11. The means of claim 7 wherein the walls of said flask said cap means and said liquid withdrawal tube are all fabricated of stainless steel.

12. The means of claim 7 wherein the width of said annular opening is between one thirty-second and one-eighth inch.

* * * * *